United States Patent [19]

Raterman

[11] Patent Number: 4,570,655

[45] Date of Patent: Feb. 18, 1986

[54] APPARATUS AND METHOD FOR TERMINATING COIN SORTING

[76] Inventor: Donald E. Raterman, 1345 Carol La., Deerfield, Ill. 60015

[21] Appl. No.: 536,686

[22] Filed: Sep. 28, 1983

[51] Int. Cl.[4] ..... G07D 3/14

[52] U.S. Cl. ..... 133/3 A; 133/8 R

[58] Field of Search ..... 133/3 R, 3 A, 3 B, 3 C, 133/3 D, 3 E, 3 F, 3 G, 3 H, 8 R, 8 A

[56] References Cited

U.S. PATENT DOCUMENTS

| | | | |
|---|---|---|---|
| 1,894,190 | 12/1930 | Myers | 133/3 R |
| 1,979,659 | 1/1928 | Zierick | 133/3 A |
| 2,231,642 | 7/1934 | Seemel | 133/8 R |
| 2,906,276 | 3/1956 | Blanchette et al. | 133/3 R |
| 2,977,961 | 12/1957 | Buchholz et al. | 133/3 R |
| 3,771,538 | 11/1973 | Reis | 133/3 D |
| 3,837,139 | 9/1974 | Roseberg | 133/8 R X |
| 4,086,928 | 5/1978 | Ristvedt et al. | 133/3 A |
| 4,098,280 | 6/1978 | Ristvedt et al. | 133/3 A |
| 4,234,003 | 11/1980 | Ristvedt et al. | 133/3 A |

FOREIGN PATENT DOCUMENTS 2012863 3/1970 Fed. Rep. of Germany .

*Primary Examiner*—F. J. Bartuska

*Attorney, Agent, or Firm*—Leydig, Voit & Mayer

[57] ABSTRACT

The invention relates to a coin sorter apparatus for sorting a group of mixed coins by denomination and automatically terminating the sorting process in response to a sensed operating parameter. Sorting is provided by a stationary disk and a rotating disk positioned sufficiently proximate to one another so that when the group of mixed coins are dropped into the center opening of the stationary disk, they are rotated by the rotating disk and guided by the stationary disk on a radially outward spiral sorting path which exits each denomination of the coins at discrete locations along the periphery of the stationary disk. As the coins are sorted, a sensing device provides signals indicating the presence of a predetermined condition. A bridge guide and a diverter guide, which are part of the stationary disk, are responsive to the signals from the sensing device to redirect the radially outward sorting path of the coins to a radially inward path so as to terminate the sorting process. Optionally, a circuit responsive to the sensing device controls the application of power to the motor powering the rotating disk of the sorter apparatus and cuts off that power, when the sorting process is terminated in order to prevent abrasion of the re-circulating coins or damage to the sorter apparatus.

20 Claims, 7 Drawing Figures

APPARATUS AND METHOD FOR TERMINATING COIN SORTING

FIELD OF THE INVENTION

The present invention relates generally to an apparatus and method for sorting coin currency by denomination and, more particularly, to an apparatus and method for sorting coins by denomination which stops the sorting process in response to a sensed predetermined condition.

BACKGROUND OF THE INVENTION

Some businesses, particularly banks, are often faced with a large amount of coin currency at the end of a business day, week or mouth which must be organized, counted and recorded. To hand count and record large amounts of coins of mixed denomimations requires diligent care and effort and demands much manpower time that might otherwise be available for more profitable and less tedious activity. To make counting of coins less laborious, machines have been developed which automatically sort by denomination a mixed group of coins.

Without the ability to control the automatic sorting process, the machine user must remain in the vicinity of the machine during its operation to ensure the machine can be stopped in case of a malfunction. In addition, the user must remain near-by in order to remove filled receptacles of sorted coins.

SUMMARY OF THE INVENTION

It is the primary object of this invention to provide an improved coin sorter mechanism which is capable of automatically sorting and counting coins at a high speed and quickly terminating the sorting process when a predetermined condition has been sensed. It is a related object of this invention to provide a mechanism which automatically stops sorting coins when a coin receptacle is filled with a predetermined number of coins without the need for manually stopping the coin sorter mechanism.

It is also an object of the invention to provide a coin sorter apparatus which can be safely left for unattended operation without any danger of receptacle overflow, jamming of the apparatus or excessive coin abrasion.

It is still another object of this invention to provide a coin sorter apparatus which stops the movement of coins through the sorting mechanism in a simple and reliable fashion in response to a predetermined condition that can be represented by an electrical signal.

It is yet another object of this invention to provide a coin sorter mechanism which satisfies the foregoing objects and whose size allows it to be easily and conveniently placed in the work space of most businesses.

Other objects and advantages of the invention will be apparent from the following detailed description.

The invention relates to a coin sorter apparatus for sorting a group of mixed coins by denomination and automatically terminating the sorting process in response to a sensed operating parameter. Sorting is provided by a stationary disk and a rotating disk positioned sufficiently proximate to one another so that when the group of mixed coins are dropped into the center opening of the stationary disk, they are rotated by the rotating disk and guided by the stationary disk on a radially outward spiral sorting path which exists each denomination of the coins at discrete locations along the periphery of the stationary means. As the coins are sorted, a sensing means provides signals indicating the presence of a predetermined condition. A bridge guide and a diverter guide, which are part of the stationary disk, are responsive to the signals from the sensing means to redirect the radially outward sorting path of the coins to a radially inward path so as to terminate the sorting process. Optionally, a circuit responsive to the sensing means controls the application of power to the motor powering the rotating disk of the sorter apparatus and cuts off that power, when the sorting process is terminated, in order to prevent abrasion of the re-circulating coins or damage to the sorter apparatus.

Although the invention will be described in connection with certain preferred embodiments, it will be understood that it is not intended to limit the invention to those particular embodiments. On the contrary, it is intended to cover all alternatives, modification and equivalents that may be included within the spirit and scope of the invention as defined by the appended claims.

DESCRIPTION OF THE PREFERRED EMBODIMENT

Figure 1:
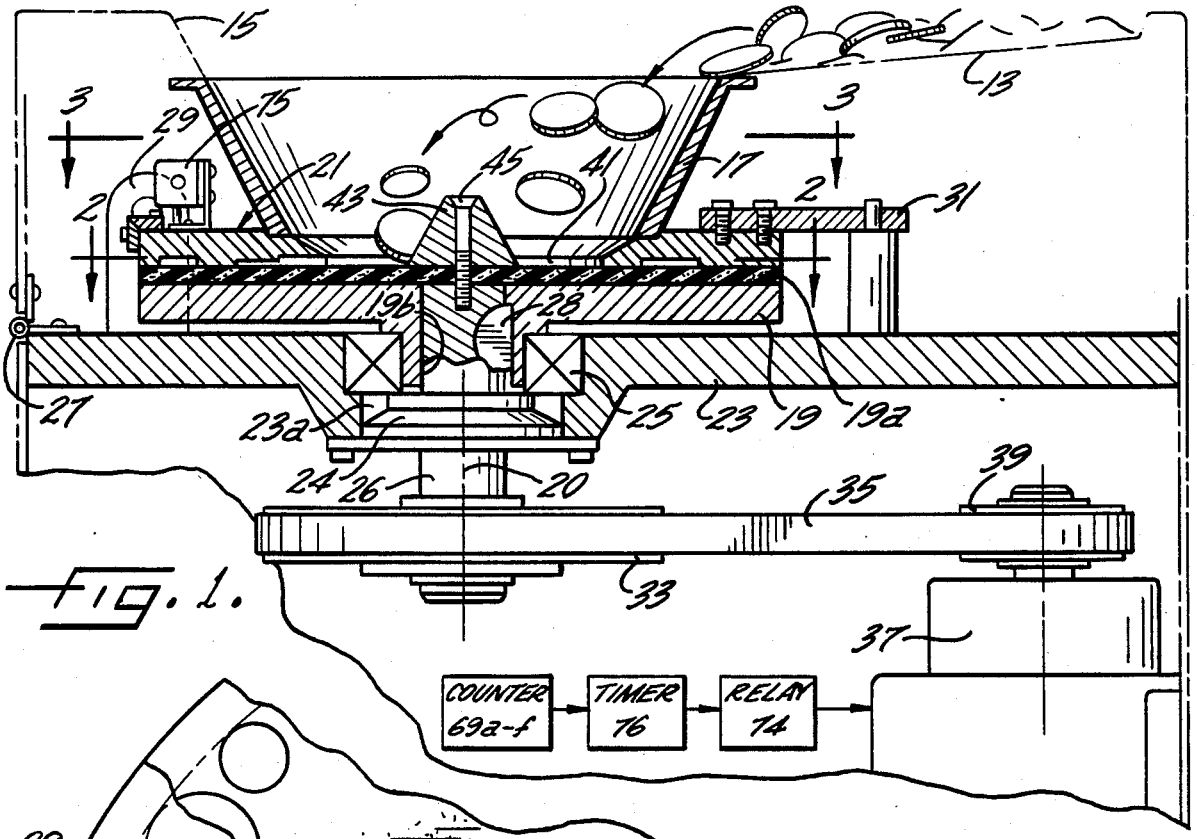
FIG. 1 is a cross-sectional view of a coin sorter apparatus which can utilize the coin sorter apparatus according to the invention.

Referring first to FIG. 1, a coin sorter machine is shown which might utilize the coin sorter apparatus according to the invention to rotate coins in an outwardly spiral orbit and eject each different denomination of coin from the sorting apparatus at a different selected location into a receptacle. To start the sorting process a collection of mixed denomination coins 11 is dropped onto a staging platform 13 which is an integral part of a housing cover 15. The coins 11 are manually pushed along the gentle sloping incline of the staging platform 13 and fall into a hopper 17 as indicated by the arrows in FIG. 1. The coins are directed by the hopper 17 into the coin sorter apparatus which is comprised of a rotating disk 19 and a stationary disk 21, shown in cross-section in FIG. 1. The stationary disk 21 contains recesses and ridges on its bottom surface whose purpose will be explained in greater detail in connection with FIGS. 2–7.

A resilient pad 19*a* provides the top surface for the rotating disk 19. This pad 19*a* is firmly secured to the disk 19 and, therefore, rotates along with the disk 19 about its center axis 20. Because the rotating disk and stationary disk are held closely together, coins which rotate on the resilient pad 19*a* are brought into the region between the disks and selectively pressed into the pad by the stationary disk's ridges. As a result of the manipulation of the coins by the ridges and recesses, the rotating coins are selectively allowed to move outwardly to the disk periphery in response to centrifugal force. Each denomination of coin reaches the periphery at a different location relative to the stationary disk. Therefore receptacles can be fixed at these locations to catch the sorted denominations.

Since coins are alternately pressed into and released from the pad, the pad 19*a* should be a rubber composition with a resilience of about 30 to 35 durometers. The stationary disk may be formed by machining a preheated steel core and then surface treating the disk for additional hardness by a well known gas nitriding process. Support for the sorter apparatus is provided by a base 23 which has an opening 23*a* that receives a drive shaft section 19*b* of the rotating disk 19. To allow the rotating disk 19 to turn relative to the stationary base 23, a bearing 25 is fitted between the shaft section 19*b* of the rotating disk 19 and the opening 23*a* of the base 23. To relieve the bearing 25 of the weight of the coin sorter apparatus and to prevent cantilevering of the bearing, a collar and support plate 24 are mounted at the bottom mouth of opening 23*a*.

A drive shaft 26 with a slotted key 28 extends from the drive shaft section 19*b* of the rotating disk through the collar and support plate 24. To turn the drive shaft 26 a pulley 33 is attached to the drive shaft bottom end. The pulley 33 is connected by a belt 35 to a motor 37 which also has a pulley 39 at the end of its drive shaft. The belt and pulley drive acts like a clutch mechanism by allowing the belt to slip on the pulleys in the event that coins jam between the rotating disk 19 and the stationary disk 21.

To facilitate maintenance and repair, the housing cover 15 is hinged to the base 23 by hinge 27 and the stationary disk 21 is attached to the base 23 by way of hinge 29. On the opposite side of the stationary disk from the hinge 29 is a support structure 31 which supports the stationary disk 21 in horizontal alignment over the rotating disk 19 and also provides a handle to lift the stationary disk 21 about the pivot 29. The support structure 31 and pivot 29 also fix the vertical position of the stationary disk 21, holding it close to the surface of the resilient pad 19*a* but not touching it. This avoids any possibility of degradation of the resilient pad surface through frictional wear against the stationary disk.

As can be seen in the cross-section of FIG. 1, the stationary disk 21 has a central opening 41 which exposes a portion of the resilient pad 19*a* such that coins dropped from the hopper 17 land on the resilient pad 19*a* of the rotating disk 19. Because the coins tend to move on the rotating disk in a spiraling orbit, the central opening 41 is circular in shape in order to allow for this natural movement. To prevent bunching of the coins in the center of the exposed portion of the resilient pad 19*a*, a conical projection 43 is secured by a screw 45 to the rotating disk 19 at the rotational center of the disk.

When the coins are dropped onto the exposed central surface portion of the rotating disk 19, they react to the centrifugal force imparted on them by the rotating disk by moving toward the annular side wall of the central opening 41 cut in the stationary disk 21. Simultaneously and in combination with this outward movement the coins are carried by the rotating disk 19 in an orbit about the disk's rotational center. Together these movements describe an outwardly spiraling orbit as viewed from the perspective of a stationary observer. When a coin's edge reaches the annular side wall of the central opening, its outward movement is restrained by the wall.

The annular side wall of the central opening includes a recess which allows single coins, but not multiple layered coins, to slide under the stationary disk. As will be explained in greater detail in connection with FIG. 5, coins which slide into the recess are captured between the two disks by a series of ridges and recesses in the stationary disk and are guided by these ridges and recesses to predetermined destinations which are different for each coin denomination. Due to cooperation between the resilient surface of the rotating disk and the ridges and recesses of the stationary disk, the coins' radial movements are, in part, guided by alternately pressing the coins into the rotating disk and releasing them as the rotating disk carries the coins in an orbit under the stationary disk. As a complement to this, edges composed of junctions between ridges and recesses guide the coins in their orbit by creating barriers to the radial movement of the coins. The recesses and ridges of the stationary disk are strategically positioned along the rotational path of the coins so as to utilize the centrifugal force imparted on the coins by the rotating disk in such a way as to sort the coins by denomination.

A useful way to describe the functional interrelationship of the rotating disk and stationary disk is to view the stationary disk as a guiding mechanism. If the stationary disk were removed from its position proximate to the surface of the rotating disk, coins placed on the rotating disk would exhibit an orbital path having a constant radial component as a result of the unhampered centrifugal force acting on the coins. As a result the coins would be flung off the rotating disk surface in a haphazard manner. The stationary disk serves to controllably guide the radial movement of the coins and thereby impart to the coins a controlled orbit which steadily increases in radius. While on route in this controlled outwardly spiraling orbit or arcuate path, the coins are sorted by the guiding action of the stationary disk.

Each area of ridges and recesses in the stationary disk guides the coins in a particular manner to prepare the coins for the journey to and manipulation by a following area of ridges and recesses. Guiding is provided by an edge or side wall defined by a combination of a ridge and recess which serves as a guide surface for the edges of the coins which are urged against the side wall by centrifugal force. By selective guiding of the coins by the stationary disk, the coins are carried in an outwardly spiral orbit on the resilient surface of the rotating disk which segregates the coins by denomination.

As the coins are carried on the rotating disk their path comprises two well defined movements between the surface of the stationary disk and the rotating disk. If the coins are kept pressed into the pad by the ridges and recesses of the stationary disk, the coins will not move radially under the influence of centrifugal force but will be carried on the resilient pad at a constant radius to define a circular orbital path about the center of the rotating disk. If during their orbit the coins are brought into a recess in which the coins are not pressed into the pad, the coins will move outwardly on the pad in response to centrifugal force, thus giving the coin orbit a radial component which moves the orbit farther out from the disk center until the orbit's radial component is met by an edge of a ridge-recess combination in the stationary disk. As long as the coins are not pressed into the resilient pad 19*a* they will remain against the stationary disk edge as they continue to orbit. In short, the recesses and ridges in the bottom surface of the stationary disk take advantage of the natural movement of the coins as they orbit to position the coins at particular disk radii which align their orbits so that recesses in the stationary disk encountered by the rotating coins will selectively exit the coins from between the two disks.

Figure 2:
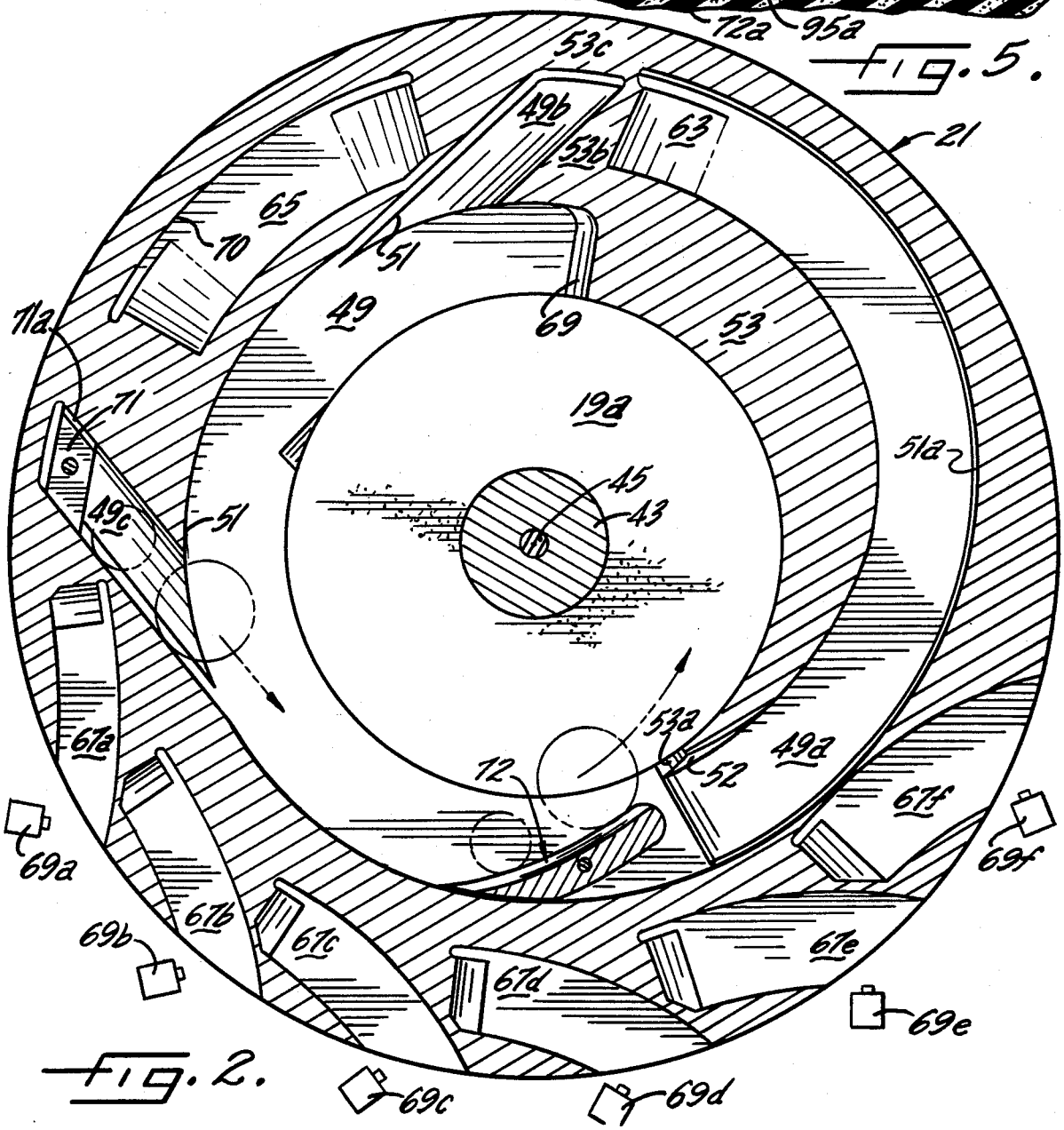
FIG. 2 is a full sectional view of the stationary disk of the coin sorter apparatus taken along the line 2—2 in FIG. 1 showing the position of the guide elements of the recycle mechanisms according to the invention.

Referring now to FIG. 2, the ridge region 53 occupies a large portion of the surface of the stationary disk facing the resilient pad 19*a*. The ridge region 53 is parallel with the resilient pad 19*a*, and sufficiently proximate to it so that coins of all denominations are pressed into the pad when they pass under the ridge region 53. As long as a coin is pressed into the pad it will be carried on the pad at a fixed location and will rotate under the recesses and ridges of the stationary disk at a constant radial position as determined by the last recess in which the coin was allowed to move radially.

To facilitate an understanding of the coin movement, the full sectional view in FIG. 2 has been taken through the ridge region 53 of the stationary disk such that the cross-hatched area in FIG. 2 serves as a reference plane for the recesses in the disk. The non-cross-hatched areas of the stationary disk correspond to recessed areas of various depths. Also to facilitate understanding of coin movement, adjoining recesses with related depths have been designated with the same numeric identifier and an individual alpha identifier (e.g., 49, 49*a*, 49*b*, 49*c*).

As mentioned in connection with FIG. 1, to begin its journey, a coin is dropped from the staging area 13 and hopper 17 onto the resilient pad 19*a* of the rotating disk 19. As can be seen in FIG. 2, the stationary disk 21 has a recess 49 which first receives the rotating coins on the rotating disk 19 under the surface of the stationary disk 21. In order to insure that two coins layered together do not enter the recess 49, the recess is only deep enough to accept the thickest coin. As the coins are accepted into the recess 49 they are being carried on the pad surface in an orbit about the center of the rotating disk while simultaneously moving radially over the pad surface toward the disk periphery. Radial movement of the coins is limited by the outer edge 51 of the recess 49.

As the rotating disk 19 rotates under the stationary disk the coins are carried through the recess 49 to recess 49*a*. Recess 49*a* has approximately the same depth as recess 49, and therefore has a depth sufficient to not press the coins into the resilient pad 19*a*. Consequently the coins can move radially to the edge 51*a* which cams the edge of the coin to guide the coin along the recess 49*a*.

At this point, with portions of ridge 53 on either side of recess 49*a*, the recess and ridge form a channel which captures those coins which have been guided by edge 51. To ensure larger diameter coins do not get stuck against the inside edge of the recess (because of the slight wedging action caused by the recess edges being slightly less than vertical), the inside edge of recess 49*a* includes a bulged area 52. This bulged area gives enough room in the recess 49*a* for the larger diameter coins to succumb to the centrifugal force and move to the outside edge 51*a* of recess 49*a*.

If a coin is not properly aligned by edge 51 before it approaches the entrance to recess 49*a*, it will be intercepted by a segment 53*a* of the ridge 53. Ridge 53*a* presses the coin into the resilient pad 19*a* and prevents the coin from moving radially. The coin thus moves with the rotating disk under ridge 53*a* in a circular counterclockwise arc to where ramp 69 releases the coin into region 49 again; as described previously, recess 49 releases the coin from pressed engagement with the pad so that the coin is free to move radially toward edge 51. The coin released by ramp 69 will move radially outward under the influence of centrifugal force and will be guided by edge 51 which directs the coin movement into recess 49. Now the coin is on the correct path to properly enter recess 49*a*.

In the recess 49*a* the coins are in a single file and are guided by edge 51*a* which adjusts the radial position of the coins. At the end of recess 49*a* the coins are pressed into the resilient pad 19*a* by a wedge 63 which is an incline bridging the depth level of recess 49*a* with the ridge 53. As the coins are carried by the rotating disk 19, the coins are steadily pressed into the resilient pad 19*a* as the rotating coins are moved under the gradual incline of the wedge 63. Further movement of the coins on the rotating disk 19 brings the coins partly under a recess 49*b*.

Because a coin of relatively small diameter may not be caught by the ridge 53*a* and yet may be misaligned in the recess 49*a*, recess 49*b* provides a path to return these misaligned coins to the center of the resilient pad 19*a* for recirculation. Coins adjacent to a misaligned coin could prevent the misaligned coin from moving out radially to meet the outer edge 51*a* of the recess 49*a*. If this misalignment were not corrected, the coin could be led into the recess 65 at a misaligned radial position which could result in the coin improperly exiting from one of the recesses 67*a*–67*e* or possibly not exiting at all and jamming the machine.

As correctly aligned coins leave recess 49*a* they will be pressed into the pad by the wedge 63 and ridge 53*b*, and they will be kept pressed into the pad by the ridge 53*c* as they pass under recess 49*b*. Since the coins are pressed into the pad, they cannot move radially in response to centrifugal force. Instead the coins follow a path of constant radius. Even though the correctly aligned coins pass partly through recess 49*b*, some portion of each coin is always in contact with the ridge 53, 53*b* or 53*c* (the cross-hatched area). Accordingly, the coins are pressed into the resilient pad throughout their journey past recess 49*b*. As the coins are held pressed into the pad by the ridge 53, the coins rotate along a constant-radius arc into recess 65.

As misaligned coins leave recess 49*a* they will also be pressed into the resilient pad 19*a* by wedge 63 and held in pressed engagement with the pad by the ridge 53*b*. Since misaligned coins are located at a radial position spaced inwardly from that of correctly aligned coins, the outer edges of such coins do not stay under ridge portion 53*c*. Therefore, the misaligned coins are released from a pressed engagement with the resilient pad 19*a* by the recess 49*b*.

Although most of the recesses have bottom surfaces which are approximately parallel with the resilient pad 19*a*, the recess 49*b* is slightly angled (e.g., $5\frac{1}{4}$ degrees)

with respect to the pad surface. Such an angle allows misaligned coins to ramp up the recess and away from pressed engagement with the pad. When the leading edges of misaligned coins hit the extension of the wall 51 in recess 49*b*, they are sufficiently free from pad pressure to move radially inwardly. The edge 51 of the recess 49*b* guides the coins back into recess 49 for another attempt at proper alignment within recess 49*a*.

Any coin denomination of a diameter less than the width of the recess 49*a* can experience the problem of misalignment. In practice, the larger the diameter of a coin, the less likely the coin is to be misaligned in recess 49*a*. In fact, experience indicates that only small diameter thin coins, are misaligned in recess 49*a*. Nevertheless, coins which have a diameter greater than the width of recess 49*b*, yet small enough to be misaligned in recess 49*a*, such that their radially outside edges are located inwardly of ridge 53*c*, can also be guided by recess 49*b* back to recess 49. Even though part of the coin remains under ridge 53*b* (because of its diameter being larger than the width of recess 49*b*) the coin's leading edge meets edge 51 which successfully guides the coin radially inwardly.

It can occur that correctly aligned coins passing under recess 49*b* can be slightly shifted in their radial position. To correct this, correctly aligned coins pass recess 49*b* and enter recess 65 which allows the coins to be realigned against the radially outer edge 70 of the recess 65. Recess 65 and edge 70 allow the coins in the sorting path an opportunity to realign their outer edges at the radial position required for correct sorting.

From the recess 65 the pad rotation carries the radially correctly aligned coins into an area of the stationary disk which has a series of recesses 67*a*–67*f* for allowing properly sized and positioned coins to exit from between the disks. Each of the recesses 67*a*–67*f* acts as an exit chute for a particular coin denomination by releasing that particular coin from pressed engagement with the pad 19*a*. After the coins have been released from the pad, they are free to move radially along the recess and exit into a coin receptacle.

Since all denominations have their outer edges guided to the same radial position by edge 70, it is only the coin inner edge which is at a unique radial distance for each denomination. Therefore, the associated recesses 67*a*–67*f* which allow the different coins to exit from between the disks must be arranged on the stationary disk so that the coins pass under them in an order of ascending width. To accomplish this, the recesses 67*a*–67*f* are aligned in a counterclockwise order of ascending width.

In order to sense the coins leaving the recess 67*a*–67*f* and thereby keep an accurate count of the sorted coins in each receptacle, a series of counters 69*a*–69*f* are positioned at the periphery of the stationary disk 21 and proximate to each opening for recesses 67*a*–67*f*. Each counter may consist of a well-known counting device, such as a conventional quenched oscillator.

When any of the counters 69*a*–69*f* reaches a predetermined count, the retractable bridge guide 71, positioned between recess 65 and recess 67*a*, can be raised from a first position to a second position wherein the rotating coins are caused to be recirculated radially inwardly back to the center opening of the stationary disk 21. When all the counters 69*a*–69*f* are at less than a predetermined count, the retractable bridge 71 is in its first position which allows coins to pass under the bridge unobstructed, thereby allowing the sorting function to operate. Bridge guide 71 is an insert in recess 49*c* which is substantially the same as recess 49*b* except that with the bridge guide 71 in its raised position, all coins in the sorting path are intercepted by the recess. By placing the bridge guide 71 in its raised position, the radial extent of the recess 49*c* is increased to a point past the radial position of the circumferential sorting path of coins exiting recess 65 and approaching recesses 67*a*–67*f*. As indicated by the coins represented in recess 49*c*, and as explained in connection with recess 49*b*, coins of all diameters are capable of being re-circulated by the recess 49*c*.

The bridge guide 71 in FIG. 1 has a flat bottom surface which occupies a coplanar position with ridge 53 when in its lowered position. Coins passing under recess 49*c* when the bridge guide is in its lowered position will not be moved radially inwardly since the bridge guide 71 holds the coins in pressed engagement with the resilient pad and prevents the coins leading edges from ramping along the slope of the recess 49*c* into engagement with edge 51. As the arrow indicates in FIG. 2, the recess 49*c* when the bridge guide 71 is in its raised position, redirects coins away from the sorting path to the recess 49 and toward the central area of the stationary disk 21.

In accordance with an important aspect of the invention, a retractable diverter guide 72 in the stationary disk 21 can be lowered or raised between two positions and is located proximate to the mouth of recess 49*a* so as to prevent coin jamming in the sorter apparatus when the bridge guide 71 is activated. When the bridge guide 71 is activated and raised, diverter guide 72 is simultaneously activated and lowered. When bridge guide 71 is moved into its raised or activated position, so as to redirect coins radially inwardly, the redirected coins tend to slow as they crowd into the center of the stationary disk. Since the coins have been inwardly redirected they have added a inwardly radial component to their motion vector and reduced their circumferential component. Since a redirected coin must overcome the outwardly radial centrifugal force imparted by the rotating disk 19, the inwardly radial component of motion does not totally compensate for the reduced circumferential motion. Consequently, the redirected coins tend to slow down in recess 49*c*. If coins continue to enter recess 49*a* at a rapid rate, backlogging and eventual jamming of the sorter apparatus may result. In its lowered position, diverter guide 72 blocks coin access to recess 49*a*, thus preventing more coins from entering the sorting path and possibly backlogging at recess 49*c* and jamming the sorter apparatus.

Figure 3:
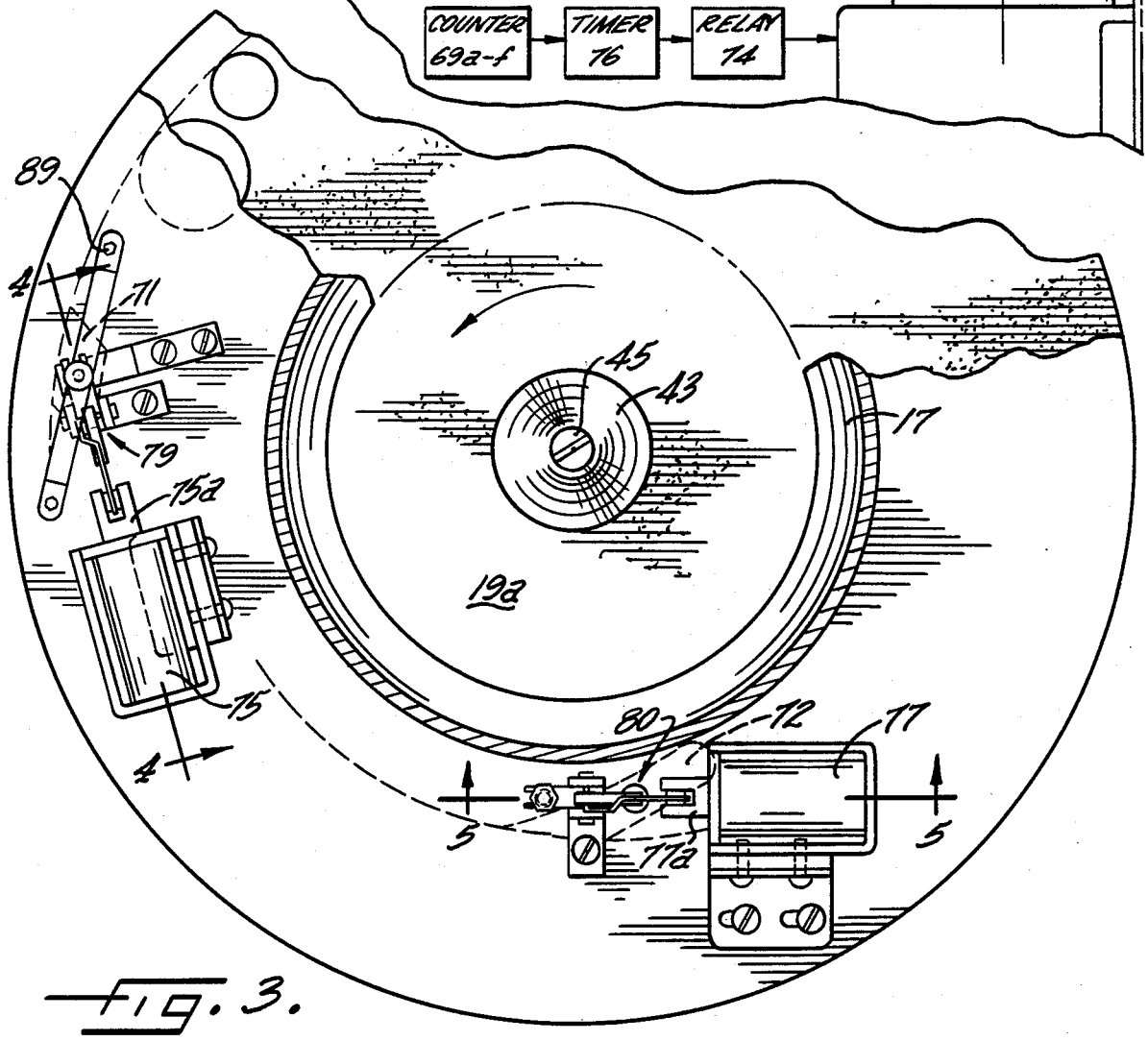
FIG. 3 is a partial sectional view of the coin sorter apparatus taken along the line 3—3 in FIG. 1 showing the top of the stationary disk partially sectioned to expose the rotating disk beneath it and also showing the recycle mechanisms which control the guide elements.

The bridge guide 71 and diverter guide 72 are moved between their raised and lowered position by solenoids 75 and 77 positioned on the top surface of the stationary disk 21 as shown in FIG. 3. In order to stop the sorting process and re-circulate the coins to the central area of the stationary disk, the plungers 75*a* and 77*a*, by way of linkages 79 and 80 respectively, raise the bridge guide and lower the diverter guide. Both solenoids are responsive to the counters 69*a*–69*f* or other sensing devices so as to energize their coils and pull in the plungers when any of the counters indicates a full receptacle or when other sensing devices respond to a predetermined condition.

Figure 4:
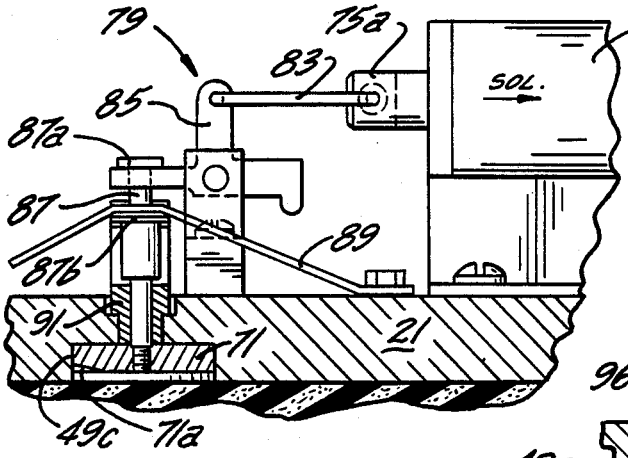
FIG. 4 is a cross-sectional view of the first recycle mechanism taken substantially along the line 4—4 in FIG. 3.
Figure 5:
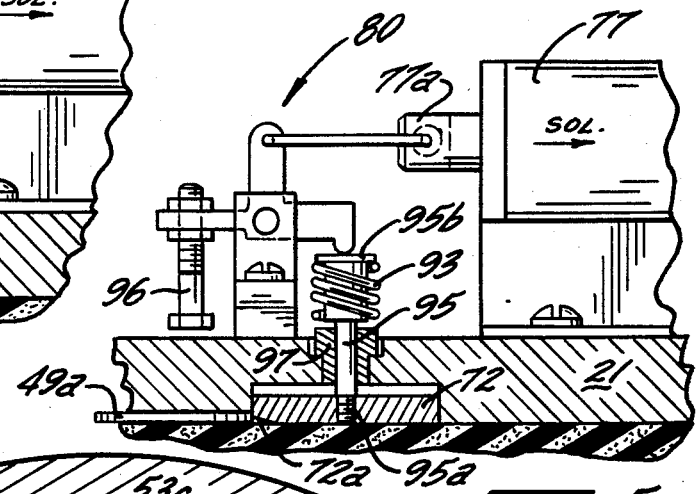
FIG. 5 is a cross-sectional view of the second recycle mechanism taken substantially along the line 5—5 in FIG. 3.

Each of the recycle mechanisms, which includes a solenoid, linkage and guide combination, is shown in cross-section in FIGS. 4 and 5 to better illustrate the interconnection of the combination. Bridge guide 71 in FIG. 4 and diverter guide 72 in FIG. 5 are shown in the positions in which they are held by an activated solenoid. Bridge guide 71 is held in a raised position so as to radially extend the recess 49*c* to capture all coins traveling along the sorting path. Diverter guide 72 is lowered so as to block all coins from entering the sorting path by way of recess 49*a*. In order to ease tolerances and yet assure proper performance of the bridge guide 71 and diverter guide 72, the beveled surfaces 71*a* and 72*a*, on the bridge guide and diverter guide respectively, provide leading edges for the guides which will not act as an edge if the guides are slightly vertically misaligned. That is, since the bridge guide 71 might not necessarily be perfectly coplanar with ridge 53 when in its lowered position, and since diverter bridge 72 might not necessarily be perfectly coplanar with recess 49 when in its raised position, the beveled leading edge assures there is no right angle edge which might be lower than the surrounding stationary head ridge or recess and therfore act as a guide edge which diverts coins instead of allowing them to pass unchanged.

Connecting the bridge guide 71 to the plunger 75*a* is the linkage 79 composed of a rod 83, a rocker arm assembly 85 and an arm 87. The rocker arm assembly 85 has one end coupled to the head portion 87*a* of the arm 87. A leaf spring 89, secured to the surface of the stationary disk, is positioned over a central platform area 87*b* of the arm 87. The bottom of the arm is threaded to the bridge guide 71 through a bushing 91 which allows the arm 87 to move vertically. When the solenoid 75 is unenergized, the leaf spring 89 holds the bridge guide 71 in its lowered position. Activation of the solenoid 75 moves the plunger 75*a* to the right in FIG. 4, thus causing the linkage 79 to pull the arm 87 and the attached bridge guide 71 up to the guide's raised position.

In a similar manner, the diverter guide 72 in FIG. 5 is moved by a solenoid 77 and a linkage 80. To hold the diverter guide 72 in a raised position when the solenoid is not activated, a coil spring 93 is positioned around an arm 95 which is threaded to the diverter guide 72 at its lower end 95*a* and topped by a flattened head at its upper end 95*b*. The coil spring 93 is compressed between the flattened head and the stationary disk 21. An adjustable stop 96 limits the stroke of the arm 95 in a bushing 97.

It will be appreciated that the solenoids 75 and 77 can be activated by signals other than those from counters 69*a*–69*f*. For example, in certain applications it might be desirable to terminate sorting in response to a signal representing (1) a surge in motor current indicating the jamming of the sorter apparatus, or (2) the accumulation of a preselected weight of coins in a receptacle. Depending on the application, many other parameters of the sorter apparatus and function could also possibly control termination of the sorting process.

In accordance with another important aspect of the invention, the rotating disk is also responsive to a predetermined condition, such as the counters 69*a*–69*f* reaching a predetermined count, to stop rotation of the rotating disk so as to prevent damage of the sorter apparatus or excessive wear to the coin surfaces when the recycle mechanisms have placed the coin sorter in a re-circulation mode. Terminating the rotation of the rotating disk 19 can be accomplished in a number of ways, one of which is to connect a relay 74 in the power line to the motor 37 which is responsive to a sensor, such as the counters 69*a*–69*f*, to remove power from the motor. Restarting the motor and sorter apparatus is accomplished simply by resetting the relay.

Preferably, activation of the relay by the counters 69*a*–*f* or other sensors is not simultaneous with activation of the bridge guide 71 and diverter guide 72, since one or two rotations of the rotating disk 19 after activation of the guides will ensure virtually all coins have been redirected out of the sorting path and back to the center of the stationary disk. To accomplish this delay in the activation of the relay 74, and to also automatically reset the relay after a lapse of a predetermined time period, a timer circuit 76 is provided which may be composed of conventional analog and/or digital circuits (e.g., astable multivibrators or binary counters respectively).

When a predetermined number of any coin denomination is received into a receptacle, the associated one of the counters 69*a*–69*f* provides an activation signal to the timer circuit 76 and to the solenoids 75 and 77 which immediately raise and lower the bridge guide 71 and diverter guide 72, respectively. After a small time delay (preferably 330 milliseconds) determined by the timer circuit 76, the relay 74 is energized. After activation of the relay 74, the timer circuit 76 measures a period equal to the maximum time for the rotating disk 19 to coast to a stop. Since at the end of this period of time (preferably 4 seconds), it is certain that the disk 19 is no longer rotating, the timer circuit 76 removes the activation signal from the relay 74 thus causing the solenoids to de-energize and the bridge and diverter guides to return to their previous positions. By automatically de-energizing the solenoids at the earliest safe opportunity, the solenoids are safeguarded from possibly burning out if the sorting apparatus is not attended to soon after a receptacle is full and the motor de-energized.

Although de-energization of the motor 37 by relay 74 and timer circuit 76 is described in connection with a signal from counters 69*a*–69*f*, the motor may be responsive to many other predetermined conditions as mentioned above. In addition, termination of coin rotation could be accomplished in other ways than de-energizing the motor 37. For example, a clutch and brake assembly could be responsive to the relay 74 to stop the rotation of the rotating disk 19.

Figure 6:
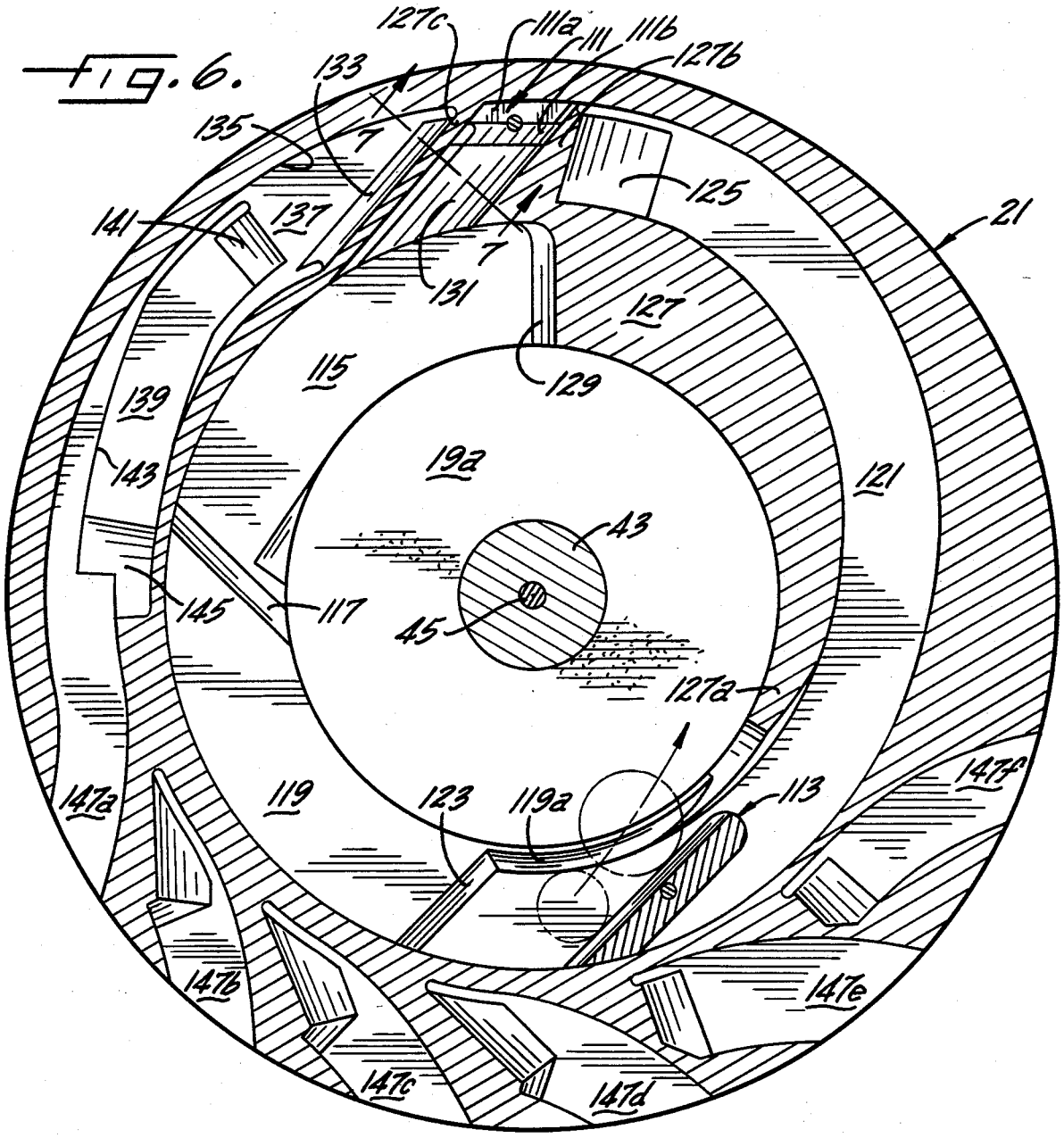
FIG. 6 is a full sectional view of the stationary disk of the coin sorter apparatus taken along the line 2—2 in FIG. 1 showing the position of the guide elements of the recycle mechanisms according to an alternate embodiment of the invention.

Referring to FIG. 6, an alternate embodiment of the stationary disk 21 is shown utilizing the recycle mechanisms of a bridge guide 111 and a diverter guide 113. In the currency of some countries, coins of different denominations may have similar diameters and different thicknesses. The stationary disk 21 in FIG. 6 utilizes thickness, as well as diameter, as a discriminating parameter to sort coins of a currency having one coin denomination of greater thickness but similar diameter as another denomination. In comparison, the stationary disk 21 in FIG. 2 sorts coins by diameter only. Since coins which are sorted by diameter are guided in substantially the same manner in both the stationary disk 21 in FIG. 6 and the stationary disk 21 in FIG. 2, only the sorting path of a coin sorted by thickness will be described in detail.

All coins are accepted into the region between the stationary and rotating disks by recess 115. Since recess 115 is deep enough to accept the thickest coin, it may sometimes happen that the thinnest denomination coins are stacked on one another in the recess. To ensure a single layer distribution of all coins, a wedge 117 leading to a slightly shallower recess 119 sweeps the tops of all coins entering the recess 119 so as to remove stacked or shingled coins. The recess 119 is sufficiently shallow so as to allow only a single layer distribution of thin coins to enter the recess directly from the central open area of the stationary disk 21. Because of the shallowness of the recess 119, the thick denomination coin cannot directly enter the recess 119 from the center of the stationary disk. Instead, it must first enter the recess 115 and then be eased into the recess 119 by the wedge 117.

From the recess 119 the coins are transferred to a deeper recess 121 by way of a ramp 123. A circumferential extension 119*a* of the recess 119 ensures that stacked or shingled coins in the center of the stationary disk do not find their way into the recess 121. A single file circumferential sorting path is created by the recess 121 as it guides the coins to a wedge 125. Coins of all thicknesses and diameters are radially aligned by the edge 127 which positions the outer edges of the single file coins. In a manner similar to the stationary disk 21 in FIG. 2, misaligned coins approaching the recess 121 are captured by an extension 127*a* of a ridge 127 and pressed into the resilient pad 19*a* so as to be rotated along an arc of constant radius which re-circulates the misaligned coins back to the recess 115 by way of a recess 129.

From the wedge 125, coins are pressed into the resilient pad 19*a* by a ridge section 127*b*. All coins correctly radially aligned in the recess 121 will stay in pressed engagement with the pad as they pass under the bridge guide 111 and the associated recess 131. As with the bridge guide 71 in FIG. 2, the bridge guide 111 in FIG. 6 is moveable between a raised and lowered position so as to bridge the recess 131 in its lowered position and to expose the radially outer portion of the recess in its raised position. In its raised position, the bridge guide 111 cooperates with the recess 131 to duplicate the function of recess 49*c* in FIG. 2.

The particular shape of the bridge guide 111 is dictated by practical considerations of construction. Because of the spacing requirements of the recesses and ridges in the stationary disk 21 shown in FIG. 6, the recess 131 must provide the functions of both recesses 49*b* and 49*c* in the stationary disk of FIG. 2. For the bridge guide 111 to allow the recess 131 to re-circulate misaligned coins when it is in its lowered or bridging position, it must not extend more radially inwardly than the ridge 53*c* in FIG. 2. Because of the practical problem of maintaining sufficient room for positioning a solenoid and its associated linkage on the top of the stationary disk and because the connection between the bridge guide 111 and the linkage requires a guide of a minimum width in order to properly connect the guide to the linkage, the bridge guide 111 must also be of a minimum width. To accommodate these requirements, the bridge guide 111 is composed of two sections 111*a* and 111*b*.

Section 111*a* is the portion of the bridge guide 111 which is parallel with the surface of the resilient pad 19*a* and, when the bridge guide is in its lowered position, is coplanar with the ridge 127. Section 111*b* is coplanar with the recess 131 when in its lowered position. In its lowered position, the bridge guide 111 cooperates with recess 131 to duplicate the function of the recess 49*b* in FIG. 2. If not for the considerations mentioned above, the bridge guide 111 would preferably only include section 111*a*. Section 111*b* would be a fixed part of the recess 131.

Figure 7:
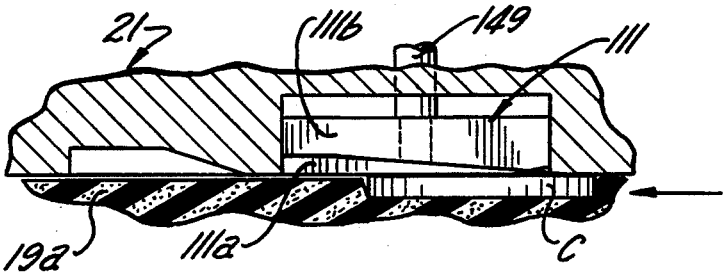
FIG. 7 is a cross-sectional view of the first guide element in the alternate embodiment of the stationary disk taken along the line 7—7 in FIG. 6.

Referring to FIG. 7, a cross-section of the bridge guide 111 in its lowered position shows the first section 111*a* coplanar with the ridge 127. The second section 111*b* is flush with the recess 131 and thereby forms a radial extension of the recess. As indicated by coin C, correctly aligned coins are kept in pressed engagement with the resilient pad 19*a* as they pass under the bridge guide 111. A rod 149 is shown in FIG. 7 which serves to connect the bridge guide 111 to a solenoid and linkage assembly on the surface of the stationary disk 21 in a manner similar to that shown in FIG. 4.

Correctly aligned coins are pressed into the resilient pad 19*a* so as to describe an arc of constant radius as they are rotated, from the ridge section 127*b*, under the lowered bridge guide section 111*a* and ridge section 127*c* and onto the ramp 133. Because the ramp 133 is angled with respect to the rotating path of the coins, there is a slight radially outward urging of coins passing under the recess. This radial urging of the coins help them realign against the edge 135 of the recess 137 and thereby compensate for any slight radial movement which might have occurred while passing under the bridge guide 111.

In order to sort coins by their thickness, the recess 137 is deep enough to allow all but the thickest denomination coin to move radially within the recess. The thickest coin is pressed into the resilient pad in the recess 137 and held at a fixed radial position. The other thinner coins are free to be radially guided by the edge 135. As the edge 135 approaches the recess 139, it increases in radial position from the center of the stationary disk. All but the thickest coins follow the edge 135 which leads the coins away from the recess 139. As a result, none of these coins enters the recess 139. Since the thickest coin is pressed into the resilient pad and held at a constant radial position in the recess 137, it rotates along a different path than the other thinner coins. This path brings the thickest coin onto the ramp 141 and into the recess 139. Since the recess 139 has a depth sufficient to free the thickest coin denomination from a pressed engagement with the pad, the coins within the recess are radially manipulated by the edge 143.

At the end of their journey through the recess 139, the coins are wedged into the resilient pad 19*a* by a wedge 145 and held in engagement by the ridge 127. Whereas all other coins have been radially positioned by the edge 135, coins of the thickest denomination have been radially positioned by the edge 143 in recess 139. Accordingly, when the coins enter under the area of the stationary disk 21 occupied by the exit recesses 147*a–f*, the coins of the thickest denomination have their radially outer edges incorrectly aligned for the exit recesses 147*a–e*. Only the recess 147*f* has a correctly positioned radial opening which releases the coins of the thickest denomination from pressed engagement with the pad and allows the coin to be guided to an exit point at the periphery of the stationary disk. Coins aligned by the recess 139 and edge 143 are never totally free of the ridge 127 as they rotate under the exit recesses 147*a–e*. Therefore, they are kept in pressed engagement with the resilient pad 19*a* and prevented from moving radially outwardly. The other thinner denominations of coins which were radially guided by edge 135 are exited in exit recesses 147*a–e* in the same manner as coins exit from recesses 67*a–f* in FIG. 2.

The exit recesses 147*a–d* have associated transitional ramps between the ridge 127 and the recess. They are shaped in a manner to provide maximum coverage by the ridge 127 for coins intended to pass partially under the recess and maintain pressed engagement with the resilient pad 19*a*. Also, the shape of the ramps reduces the likelihood of non-round coins being radially misaligned as they pass under the recesses.

In accordance with yet another important aspect of the invention, the diverter guide 113 in the stationary disk 21 can be positioned in a first position in the recess 121 so as to block entrance of coins into the recess or the guide can be positioned in a second position so as to allow coins to pass into the recess 121. As the arrow indicates in FIG. 6, when the diverter guide 113 is in its lowered position, all coins are redirected radially inwardly under the recess extension 119*a* and into the center of the stationary disk. Even though some coins may be slightly pressed into the resilient pad 19*a* when under the recess extension 119*a*, since the diverter guide 113 is coplanar with the ridge 127 when in its lowered position, the path of least resistance to the coins is that path represented by the arrow. Since only the thickest coin denomination will be pressed into the pad by the recess extension 119*a*, no significant backlogging should occur behind the diverter guide 113. As with the diverter guide 72 in FIG. 2, the diverter guide 113 in FIG. 6 blocks coin entrance to the recess 121 and thereby protects backlogging and possible coin jamming in the area of bridge guide 111.

From the foregoing it can be appreciated that the sorter apparatus according to the invention provides recycle mechanisms which intercept coins in the sorting path and redirects them away from the apparatus output in response to a signal from a sensing device associated with a sorting parameter. In combination with the interception and redirection of the coins, the rotational movement of the coins is retarded or stopped by providing a mechanism to stop the rotation of the rotating disk 19. Preferably the recycle mechanisms and the mechanism to stop the rotation of the rotating disk 19 are responsive to counters associated with the receptacles receiving the sorted denominations of coins so that the sorting function is terminated when a predetermined number of coins have filled any one of the receptacles.

I claim:

1. A coin sorter apparatus for receiving and sorting mixed coins by denomination comprising:

a rotating disk having a first surface for receiving said mixed coins and imparting a rotational movement to said mixed coins, a stationary disk having its underside parallel with and proximate to said first surface of said rotating disk for guiding said mixed coins along a sorting path, a central open area in said stationary disk for allowing coins to be received onto said first surface of said rotating disk, a first area on the underside of said stationary disk including means for selectively directing the rotating mixed coins into a sorting path within the region between the two disk, with said region allowing continued rotation of the mixed coins on the first surface of said rotating disk, a second area on the underside of said stationary disk including means for receiving said rotating coins along said sorting path from said first area in a single file configuration sorting path and manipulating the radial position of each denomination of said coins, a third area on the underside of said stationary disk including means for receiving said rotating coins in the sorting path from said second area and allowing rotating coins positioned at predetermined radial positions to exit said region between the two disks at predetermined locations along the periphery of the stationary disk, sensing means located on said coin sorter apparatus for sensing predetermined conditions, a fourth area on the underside of said stationary disk between said second area and said third area including means responsive to said sensor means for intercepting coins from said second area and guiding them to said central open area when said sensor means detects a predetermined condition, and a fifth area on the underside of said stationary disk between said first area and said second area including means responsive to said sensor means for diverting coins from entering into said second region and preventing coin movement along said sorting path when said sensor means detects a predetermined condition, whereby the diversion of coins by said fifth area means sufficiently inhibits backlogging of coins in said second area resulting from diversion of coins by said fourth area means to prevent stacking of coins in said second area.

2. A coin sorter apparatus for receiving and sorting mixed coins by denomination as set forth in claim 1 including:

a control means responsive to the detection of a predetermined condition by said sensor means to stop the rotation of the coins on said rotating disk.

3. A coin sorter apparatus for receiving and sorting mixed coins by denomination as set forth in claim 2 including:

a motor coupled to said rotating disk, and said control means being responsive to said sensor means to de-energize said motor and said rotating disk when said sensor means detects a predetermined condition.

4. A coin sorter apparatus for receiving and sorting mixed coins by denomination as set forth in claim 1 wherein said fourth area includes a recess which guides coins radially inwardly and said fifth area includes a ridge which guides coins radially inwardly.

5. A coin sorter apparatus for receiving and sorting mixed coins by denomination as set forth in claim 4 wherein said ridge includes a diverter guide mounted for movement between a first and second position and which spans the sorting path which connects the first and second area so as to permit coins in said sorting path to pass by said ridge undisturbed in said first position, and to intercept and recycle all coins in the sorting path in said second position.

6. A coin sorter apparatus for sorting a group of mixed coins by denomination and automatically terminating the sorting process, said apparatus comprising:

rotating means for imparting rotational movement to said group of mixed coins, stationary means proximate to said rotating means for guiding the rotating coins from the center of said stationary means to the periphery of said stationary means by way of a radially outward spiral sorting path such that the rotating coins exit at the periphery of the stationary means at discrete locations determined by coin denomination, a first area on said stationary means including means for selectively directing the rotating mixed coins into a sorting path, a second area on said stationary means including means for receiving said rotating coins along said sorting path from said first area in a single file sorting path configuration and manipulating the radial position of each denominatin of said coins, a third area on said stationary means including means for receiving said rotating coins in the sorting path from said second area and allowing rotating coins positioned at predetermined radial positions to exit said region between the two disks at predetermined locations along the periphery of the stationary disk, means for sensing a predetermined condition and producing an output signal in response thereto, recycle means in said stationary means responsive to said output signal from said sensing means for redirecting said rotating coins so as to prevent exiting of the coins at the periphery of said stationary means, said recycle means having (1) a first portion located between said second and third areas for diverting coins radially inwardly on said rotating means in order to prevent the final sorting of coins in said third area and (2) a second portion located between said first and second areas for diverting coins radially inwardly on said rotating means in order to inhibit backlogging and prevent stacking of coins in said second area in response to the diversion of said coins by said first portion, and control means responsive to said output signal from said sensing means to retard the rotational movement of said rotating coins so as to prevent abrasion of the coins or damage to the apparatus when sorting has been stopped by said recycle means.

7. A coin sorter apparatus as set forth in claim 6 wherein said recycle means is mounted in said stationary means for movement in and out of the radially outward spiral sorting path of the coins.

8. A coin sorter apparatus as set forth in claim 6 wherein said recycle means redirects said rotating coins radially inwardly such that the rotating coins are returned to the center of the stationary means.

9. A coin sorter apparatus as set forth in claim 7 wherein said recycle means, when positioned in the sorting path of the rotating coins, redirects the coins radially inwardly such that the rotating coins are returned to the center of the stationary means.

10. A coin sorter apparatus as set forth in claim 6 wherein said recycle means comprises a ridge in the surface of said stationary means which is movable between at least first and second positions so as to block the sorting path of said rotating coins in said first position to thereby cause said rotating coins to be redirected radially inwardly and to allow said rotating coins to pass said ridge and continue on the sorting path when in said second position.

11. A coin sorter apparatus as set forth in claim 6 wherein said recycle means includes an electromagnetic means and a diverter guide in which said electromagnetic means is responsive to said means for sensing to move said diverter guide between at least a first and second position, and said first position allowing coins in the sorting path to exit at the periphery of said stationary means and said second position intercepting coins in said sorting path and redirecting the coins radially inwardly so as to prevent their exit at the periphery of the stationary means.

12. A coin sorter apparatus as set forth in claim 6 wherein said control means retards the rotational movement of the rotating coins by stopping the rotation of said rotating disk.

13. A coin sorter apparatus as set forth in claim 10 wherein said control means retards the rotational movement of the rotating coins by stopping the rotation of said rotating disk.

14. A coin sorting apparatus comprising:

a pair of substantially parallel horizontal disks forming a pair of opposed surfaces which have at least portions thereof spaced slightly away from each other to form a region which permits coins to slide between the opposed surfaces, one of said disks being stationary and the other disk being mounted for rotation about an axis that is substantially perpendicular to said opposed surfaces, the rotatable disk having a resilient biasing surface for urging coins pressed therein toward the opposed surface of the stationary disk, said stationary disk having a central opening for allowing batches of mixed denomination coins to be introduced to a staging area on the surface of said rotating disk, means for providing a signal indicative of the presence of a predetermined condition, and the stationary disk having a plurality of recessed areas therein for releasing any coins entering any recessed areas from the biasing pressure of said resilient surface and thereby permitting radial movement of coins between the two disks by rotation of the rotatable disk, said recessed areas being (1) shaped to allow coins into the region between said disks, (2) provided with means to block coins from entering said region in response to said signal in order to prevent stacking of coins in said region, (3) shaped to guide coins in single file along an arcuate path between the disks, (4) provided with means to recirculate coins radially inwardly in response to said signal in order to remove coins from said region and return them to the staging area of said rotating disk, and (5) shaped to permit coins of different sizes to escape radially from between the disks to different predetermined positions around the periphery of the stationary disk.

15. A coin sorting apparatus as set forth in claim 14 wherein said recessed areas includes a diverter guide moveable between a first non-coin-blocking position and a second coin-blocking position in response to said signal.

16. A coin sorting apparatus as set forth in claim 15 wherein said means for providing a signal comprises at least one coin counter located proximate the peripheries of said disks for generating a signal in response to the counting of a predetermined number of coins.

17. A coin sorting apparatus as set forth in claim 14 wherein said rotatable disk is responsive to said signal to stop rotation of said rotatable disk.

18. A method for terminating the sorting of coins by a stationary disk and a rotating disk mounted with their surfaces parallel to and in close proximity with one another, said method comprising the steps of:

rotating the coins on said rotating disk, radially outwardly guiding the coins along a single file circumferential sorting path in the region between said stationary and rotating disks so as to position the radially inner edge of each coin denomination at a unique radial position in said region, intercepting each denomination at its unique radial position and discharging that denomination from said region at discrete locations along the periphery of the stationary disk for each denomination, sensing a predetermined condition, redirecting said coins in said single file circumferential sorting path in said region at a first location of the path in response to said sensed predetermined condition so as to stop further exiting of sorted coins from said region at the periphery of the stationary disk, redirecting said coins in said single file circumferential sorting path in said region at a second location of the path which is upstream from said first location in order to inhibit backlogging in said sorting path at said first location and thereby prevent stacking of coins in said region, and retarding the rotational movement of the coins in the center of the stationary disk in response to the sensed predetermined condition so as to prevent coin abrasion.

19. A method for re-circulating coins as set forth in claim 18 including the step of:

sensing the predetermined condition of a predetermined number of sorted coins exiting at any of the discrete locations along the periphery of the stationary disk.

20. A method for re-circulating coins as set forth in claim 18 including the step of:

stopping the rotation of the rotating disk in response to the predetermined condition.

* * * * *